US011628918B2

(12) United States Patent
Hsu

(10) Patent No.: US 11,628,918 B2
(45) Date of Patent: Apr. 18, 2023

(54) AMPHIBIOUS ELECTRIC SCOOTER

(71) Applicant: Chia-Teng Hsu, Taichung (TW)

(72) Inventor: Chia-Teng Hsu, Taichung (TW)

( * ) Notice: Subject to any disclaimer, the term of this patent is extended or adjusted under 35 U.S.C. 154(b) by 0 days.

(21) Appl. No.: 17/452,402

(22) Filed: Oct. 26, 2021

(65) Prior Publication Data

US 2022/0153398 A1 May 19, 2022

(51) Int. Cl.
*B63H 21/175* (2006.01)

(52) U.S. Cl.
CPC ..... *B63H 21/175* (2013.01)

(58) Field of Classification Search
CPC ..... B63H 21/17; B63H 21/175; B60F 3/0007
USPC ..... 440/6, 12.5, 12.51, 12, 30, 27
See application file for complete search history.

(56) References Cited

U.S. PATENT DOCUMENTS 547,422 A * 10/1895 Dean ..... B63H 21/175 440/12
3,826,216 A * 7/1974 Rhody ..... B63C 13/00 440/12
4,636,176 A * 1/1987 Capilla ..... F02B 61/02 180/53.6
5,522,741 A * 6/1996 Yun ..... B63H 16/12 440/12.7
5,591,056 A * 1/1997 Patino ..... B63H 21/175 440/12
9,061,557 B1 * 6/2015 Garrett ..... B60F 3/0084

* cited by examiner

*Primary Examiner* — Daniel V Venne

(57) ABSTRACT

An amphibious electric scooter includes an electric scooter and a watercraft Including a space for accommodating a portion of the electric scooter, a pivotal concave member disposed in a front portion of the space with the front wheel of the scooter disposed therein, a linking rod having a first end operatively connected to the concave member, a rudder pivotably connected to a second end of the linking rod, first and second rotating shafts adjustably disposed in the space with the rear wheel rotatably disposed thereon, a gearbox meshing with teeth of the first shaft, an inclined drive shaft extending rearward out of the gearbox, and a propeller rotatably secured to an open end of the drive shaft.

5 Claims, 8 Drawing Sheets

AMPHIBIOUS ELECTRIC SCOOTER

FIELD OF THE INVENTION

The invention relates to scooters and more particularly to an amphibious electric scooter including a watercraft and a releasable electric scooter mounted on the watercraft.

BACKGROUND OF THE INVENTION

Electric vehicles are gaining popularity in recent years because they can decrease air pollution and have other benefits and advantages. One of the electric vehicles is electric scooter. Water sports are also popular. However, no amphibious electric scooters were disclosed as far as the present inventor is aware.

SUMMARY OF THE INVENTION

It is therefore one object of the invention to provide an amphibious electric scooter comprising an electric scooter and a watercraft wherein the electric scooter comprises a deck, connector, head tube and fork assembly, a front wheel rotatably secured to a front portion of the deck, connector, head tube and fork assembly, a steering tube secured to a top end of the deck, connector, head tube and fork assembly, a T-shaped handlebar pivotably secured to a top end of the steering tube, a rear wheel rotatably secured to a rear end of the deck, connector, head tube and fork assembly, a seat and seat tube assembly extending upward from the deck, connector, head tube and fork assembly, and two battery compartments disposed at both sides of the deck, connector, head tube and fork assembly respectively; and the watercraft is shaped as a boat and comprises a space for accommodating a portion of the electric scooter, a pivotal concave member disposed in a front portion of the space with the front wheel positioned therein, a linking rod having a first end operatively connected to the concave member, a rudder pivotably connected to a second end of the linking rod, first and second rotating shafts disposed in the space with the rear wheel rotatably disposed thereon, a gearbox meshing with teeth of the first shaft, an inclined drive shaft extending rearward out of the gearbox, and a propeller rotatably secured to an open end of the drive shaft.

The above and other objects, features and advantages of the invention will become apparent from the following detailed description taken with the accompanying drawings

DETAILED DESCRIPTION OF THE INVENTION

Figure 1:
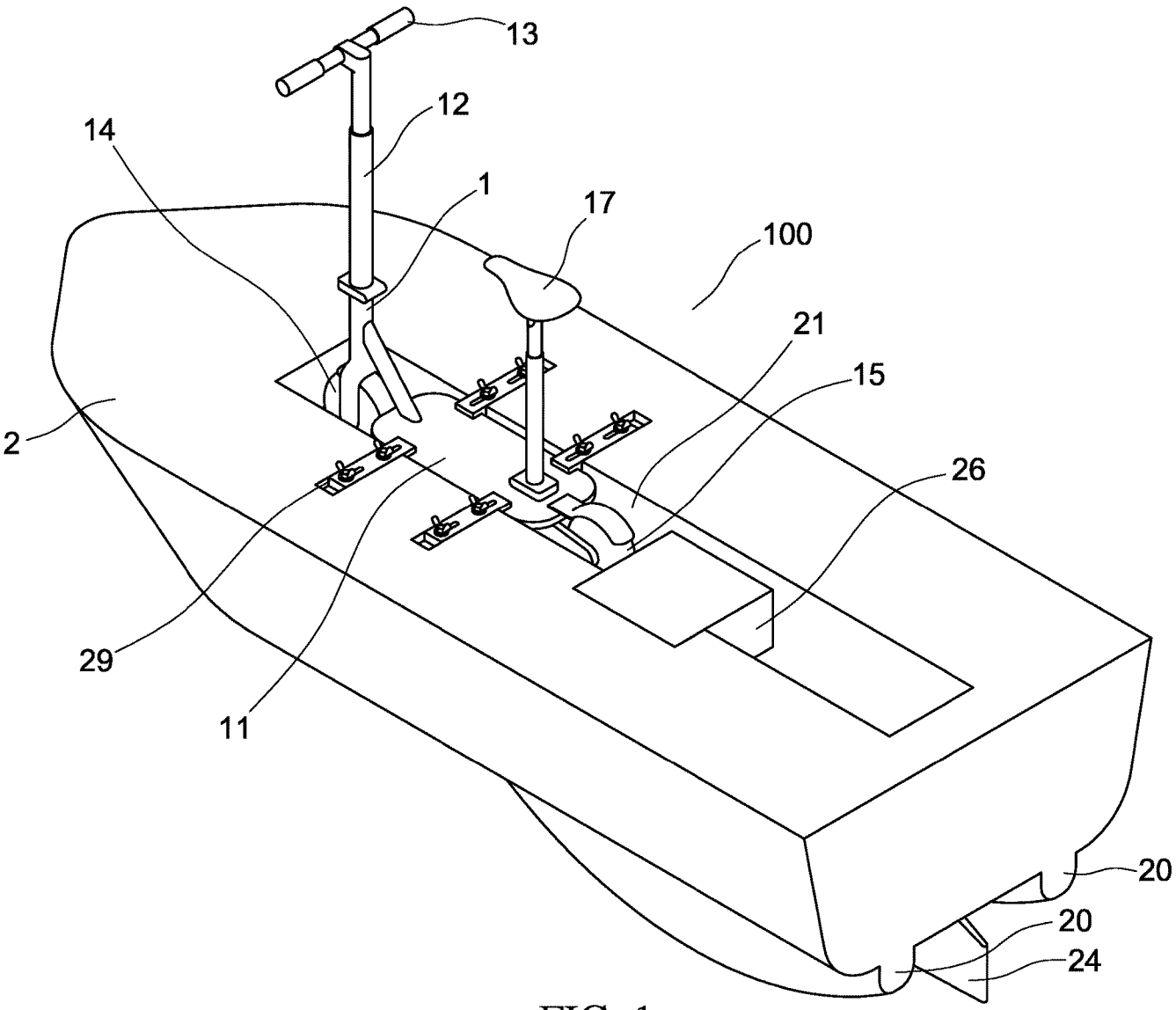
FIG. 1 is a perspective view of an amphibious electric scooter of the invention.
Figure 2:
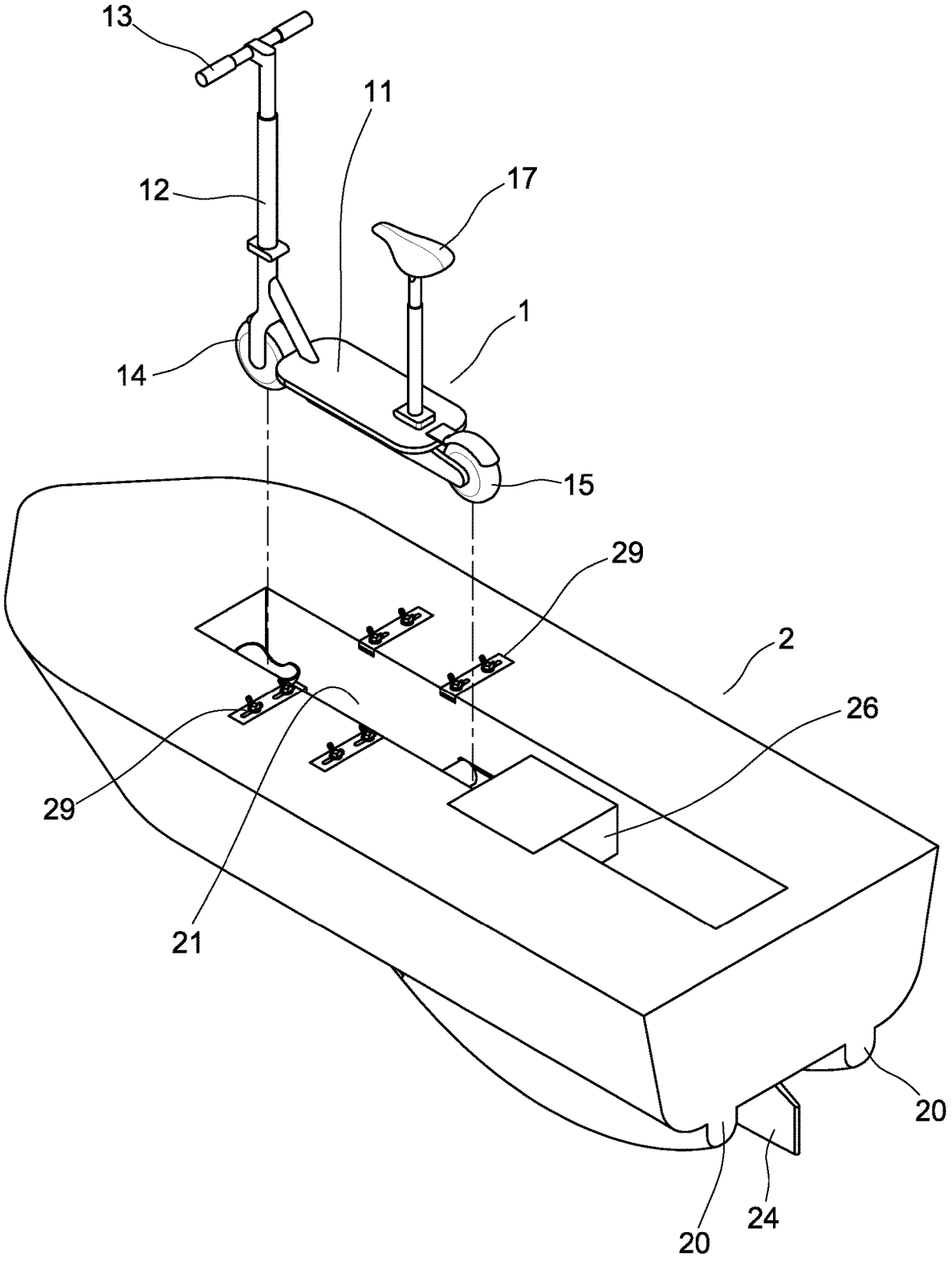
FIG. 2 is an exploded, perspective view of FIG. 1.
Figure 3:
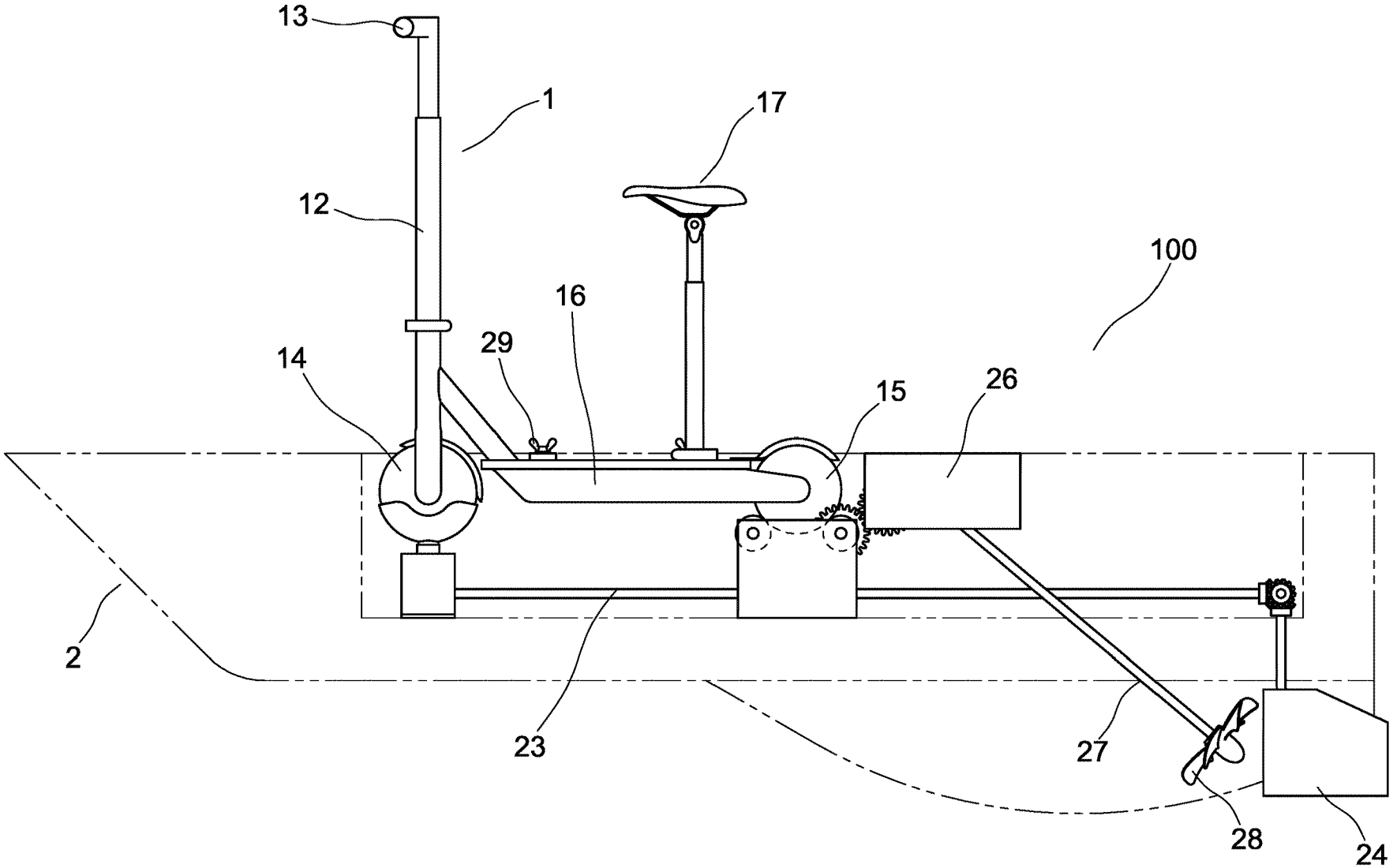
FIG. 3 is a schematic side view of FIG. 1.
Figure 4:
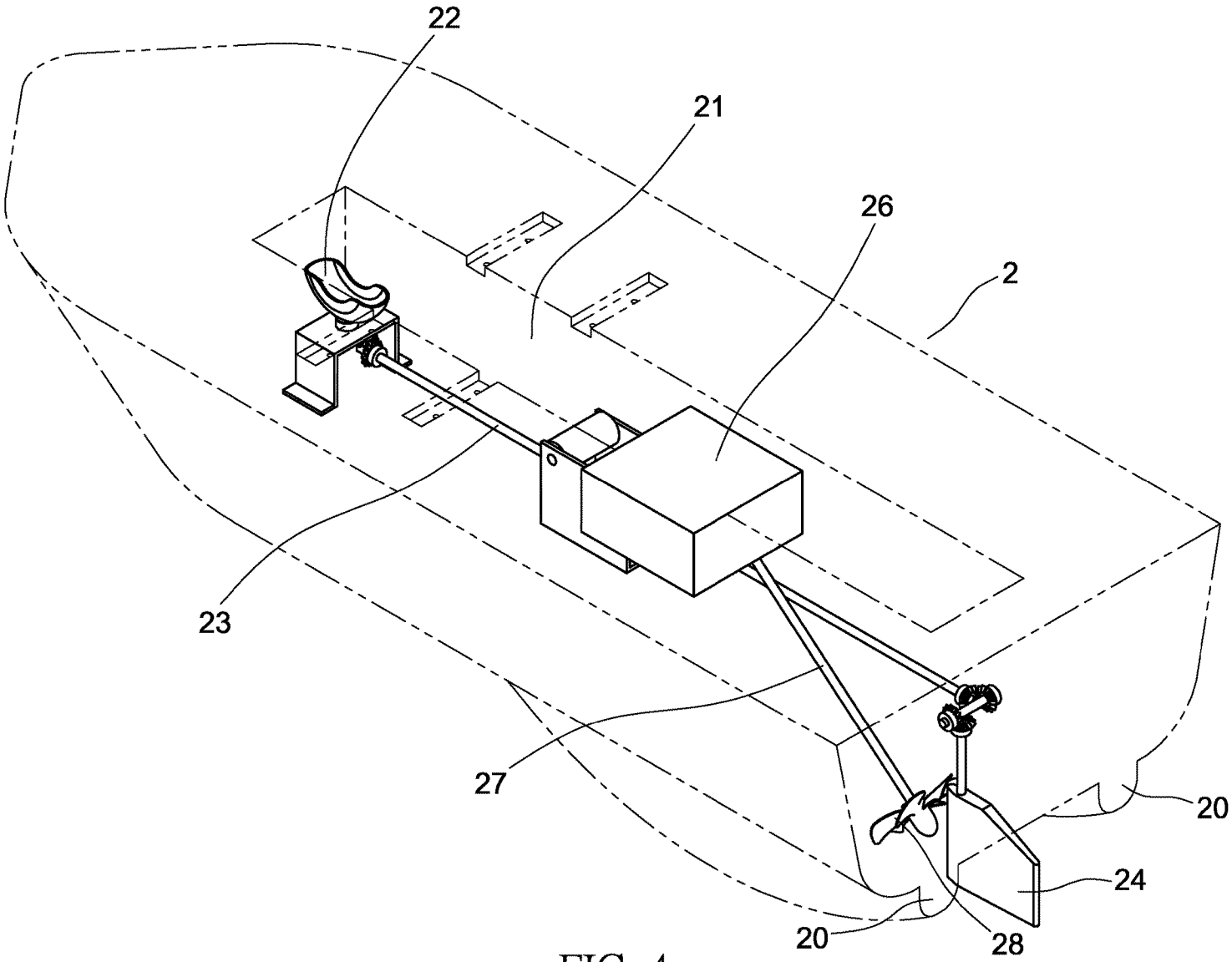
FIG. 4 is a schematic perspective view of the amphibious electric scooter with the electric scooter removed, i.e., the watercraft.
Figure 5:
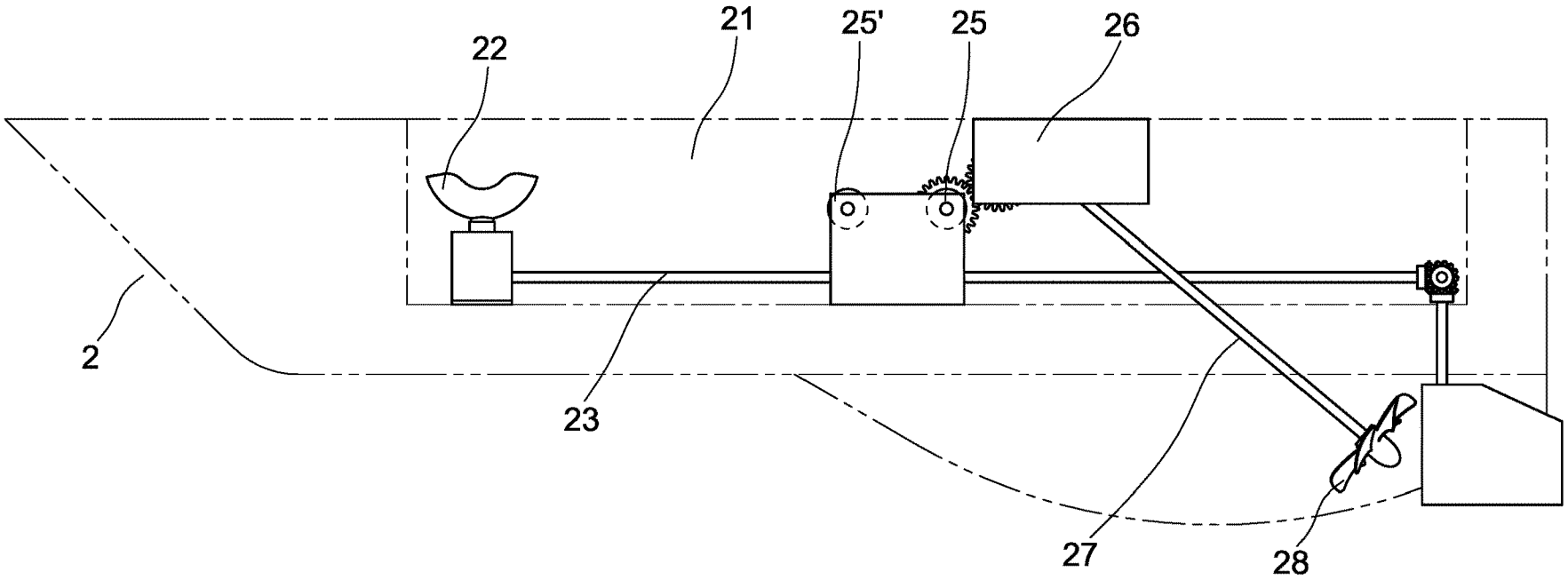
FIG. 5 is a schematic side view of FIG. 4.
Figure 6:
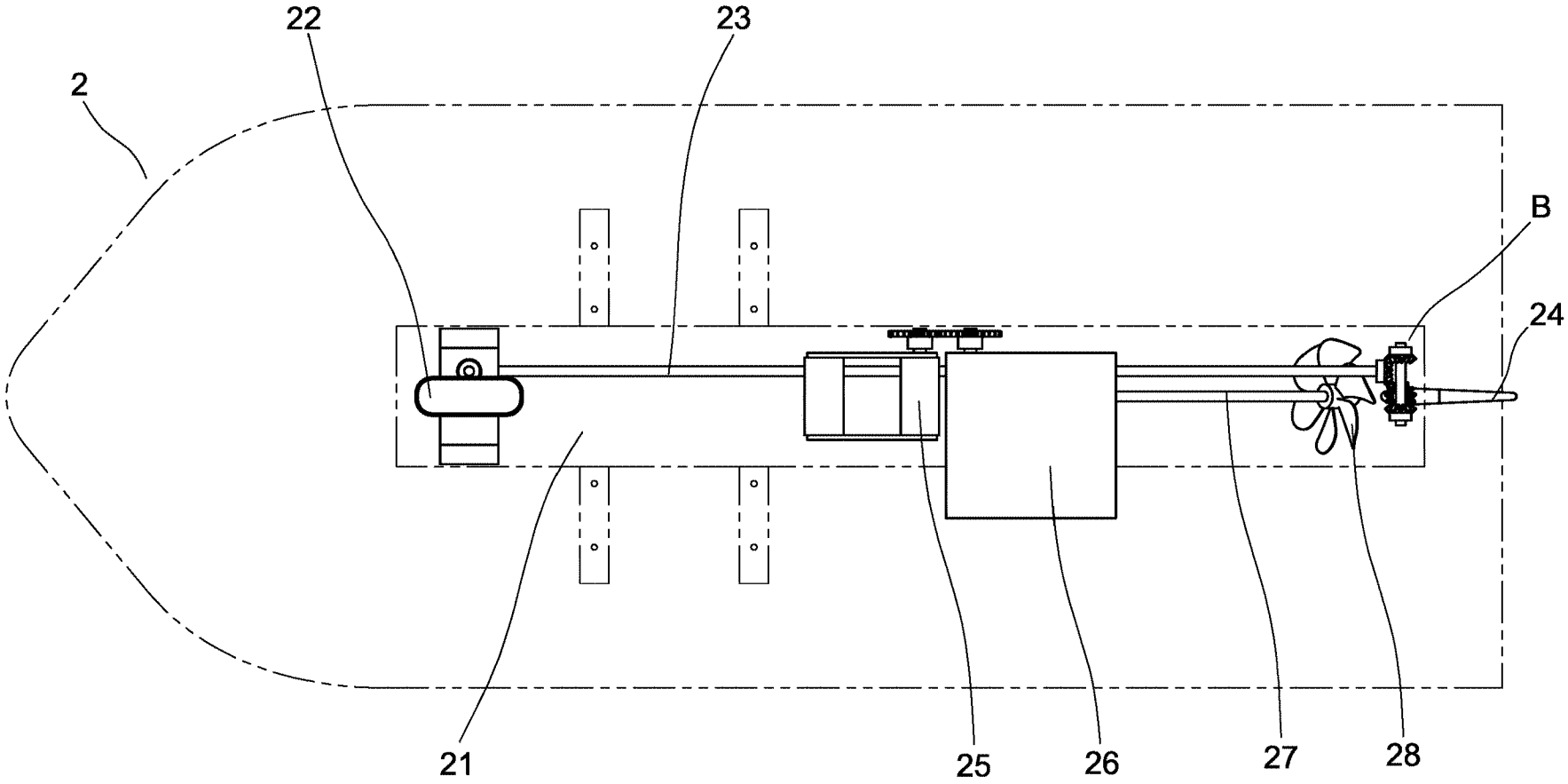
FIG. 6 is a top plan view of FIG. 4.
Figure 7:
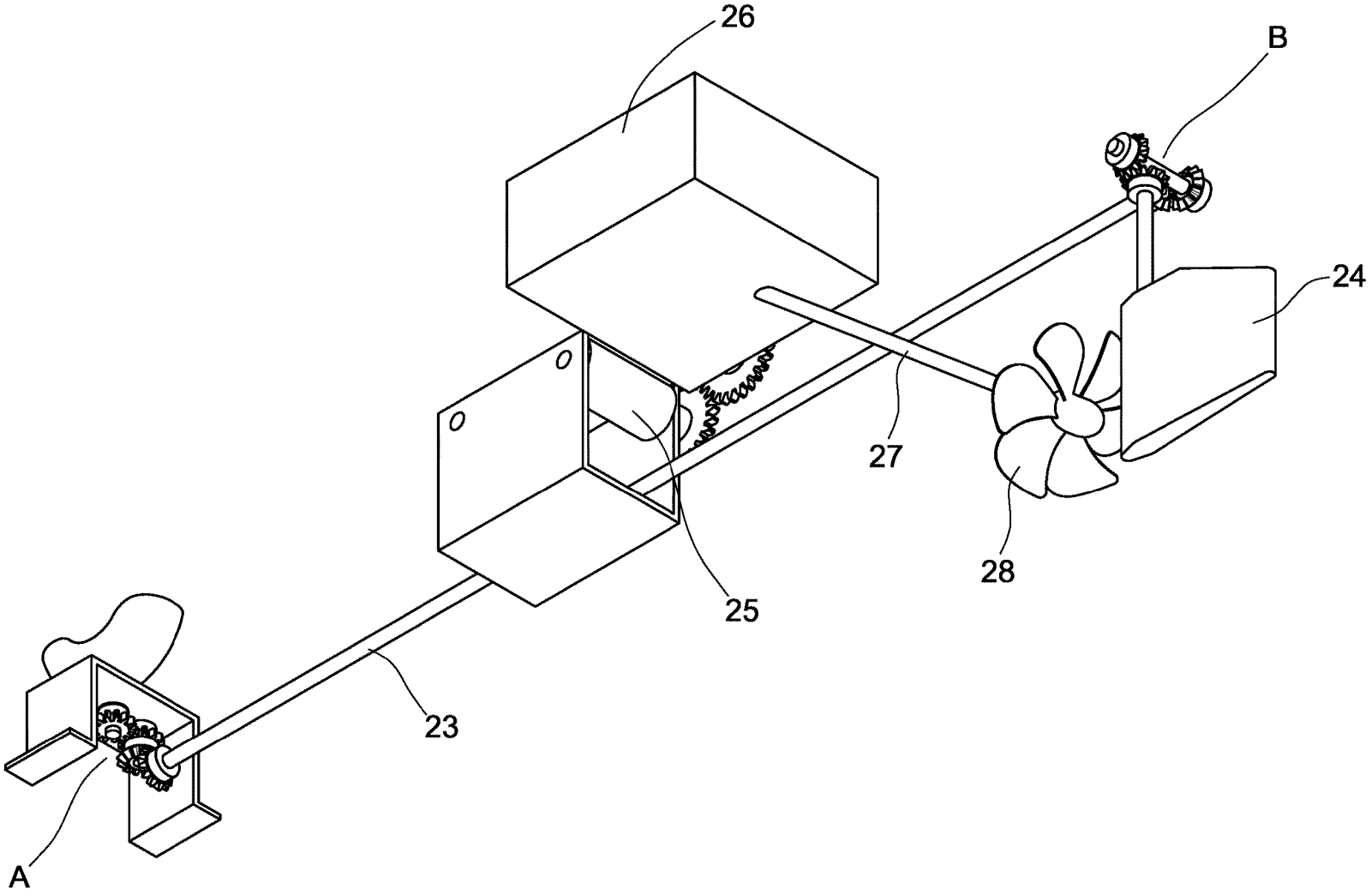
FIG. 7 is a perspective view showing operation of the watercraft.
Figure 8:
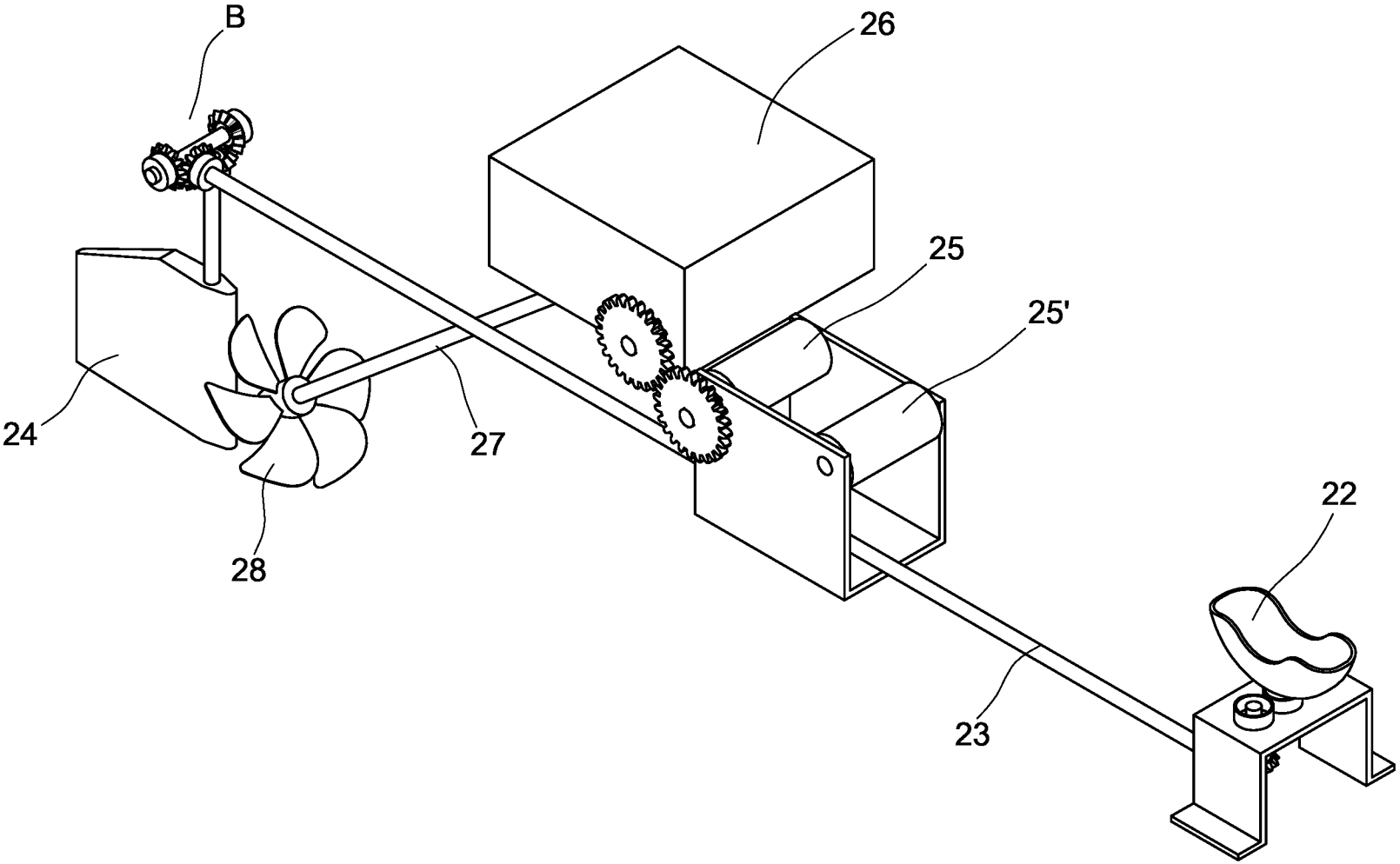
FIG. 8 is another perspective view showing operation of the watercraft.

Referring to FIGS. 1 to 8, an amphibious electric scooter 100 in accordance with the invention comprises an electric scooter 1 and a watercraft 2 as discussed in detail below.

The electric scooter 1 comprises a deck, connector, head tube and fork assembly 11, a front wheel 14 rotatably secured to a front portion of the deck, connector, head tube and fork assembly 11, a steering tube 12 secured to a top end of the deck, connector, head tube and fork assembly 11, a T-shaped handlebar 13 pivotably secured to a top end of the steering tube 12, a rear wheel 15 rotatably secured to a rear end of the deck, connector, head tube and fork assembly 11, a seat and seat tube assembly 17 extending upward from a rear portion of the deck, connector, head tube and fork assembly 11, two battery compartments 16 disposed at both sides of the deck, connector, head tube and fork assembly 11 respectively, and a rechargeable battery (not shown) mounted in each battery compartment 16 for supplying power to the amphibious electric scooter 100 in use.

The watercraft 2 is shaped as a boat and comprises a space 21 for accommodating a portion of the electric scooter 1, a pivotal concave member 22 disposed in a front portion of the space 21 with the front wheel 14 positioned therein so that a pivotal movement of the front wheel 14 may pivotably move the concave member 22, a first gear assembly A disposed at an underside of the concave member 22, a linking rod 23 having one end operatively connected to the first gear assembly A, a second gear assembly B operatively connected to the other end of the linking rod 23, a rudder 24 pivotably connected to the second gear assembly B so that a clockwise (or counterclockwise) rotation of the handlebar 13 may clockwise (or counterclockwise) turn the rudder 24 via the linking rod 23, first and second rotating shafts 25, 25' adjustably disposed in an intermediate portion of the space 21 with the rear wheel 15 rotatably disposed thereon, a gearbox 26 meshing with teeth of the first shaft 25, an inclined drive shaft 27 extending rearward out of the gearbox 26, a propeller 28 rotatably secured to an open end of the drive shaft 27, and two longitudinal stabilizers 20 disposed at two sides of a bottom of the watercraft 2 respectively with the rudder 24 disposed therebetween.

The watercraft 2 is made of injection molding, Styrofoam, or carbon fiber of low density, buoyant material.

There are further provided a plurality of quick releases 29 on a top of the watercraft 2 with the space 21 disposed therebetween so that the quick releases 29 can be operated to fasten or unfasten the deck, connector, head tube and fork assembly 11 in the space 21.

A distance between the first rotating shaft 25 and the second rotating shafts 25' can be adjusted for accommodating the rear wheel 15.

The electric scooter 1 is conventional, and both the handlebar 13 and the seat and seat tube assembly 17 can be folded, extended, compressed, and/or detached. Further, the electric scooter 1 has brakes and an accelerator.

An individual may operate the amphibious electric scooter 100 in and on water by driving the electric scooter 1 as on the land. Alternatively, the individual may detach the electric scooter 1 from the amphibious electric scooter 100 and drive the electric scooter 1 on the land.

While the invention has been described in terms of preferred embodiments, those skilled in the art will recognize that the invention can be practiced with modifications within the spirit and scope of the appended claims.

What is claimed is:

1. An amphibious electric scooter, comprising an electric scooter and a watercraft wherein:

the electric scooter comprises a deck, connector, head tube and fork assembly, a front wheel rotatably secured to a front portion of the deck, connector, head tube and fork assembly, a steering tube secured to a top end of the deck, connector, head tube and fork assembly, a T-shaped handlebar pivotably secured to a top end of the steering tube, a rear wheel rotatably secured to a rear end of the deck, connector, head tube and fork assembly, a seat and seat tube assembly extending upward from the deck, connector, head tube and fork assembly, and two battery compartments disposed at both sides of the deck, connector, head tube and fork assembly respectively; and the watercraft comprises a space for accommodating a portion of the electric scooter, a pivotal concave member disposed in a front portion of the space with the front wheel positioned therein, a linking rod having a first end operatively connected to the concave member, a rudder pivotably connected to a second end of the linking rod, a first rotating shaft disposed in the space, a second rotating shaft disposed in the space, a gearbox meshing with teeth of the first rotating shaft, an inclined drive shaft extending rearward out of the gearbox, and a propeller rotatably secured to an open end of the drive shaft wherein the rear wheel is rotatably disposed on the first and second rotating shafts.

2. The amphibious electric scooter of claim 1, further comprising a plurality of first quick releases on a first side of a top of the watercraft and a plurality of second quick releases on a second side of a top of the watercraft, and wherein the space is disposed between the first quick releases and the second quick releases, and the first and second quick releases are configured to fasten or unfasten the deck, connector, head tube and fork assembly in the space.

3. The amphibious electric scooter of claim 1, further comprising a first gear assembly disposed at an underside of the concave member, wherein the first end of the linking rod is operatively connected to the first gear assembly; and a second gear assembly operatively connected to the second end of the linking rod; and wherein the rudder pivotably is connected to the second gear assembly.

4. The amphibious electric scooter of claim 1, wherein a distance between the first rotating shaft and the second rotating shaft is configured to adjust.

5. The amphibious electric scooter of claim 1, further comprising two longitudinal stabilizers disposed at two sides of a bottom of the watercraft respectively.

* * * * *